US006368081B1

(12) United States Patent
Matsumoto

(10) Patent No.: US 6,368,081 B1
(45) Date of Patent: Apr. 9, 2002

(54) BLOWER

(75) Inventor: Kaoru Matsumoto, Kitasaku-gun (JP)

(73) Assignee: Minebea Co. Ltd., Kitasaku-gun (DE)

( * ) Notice: Subject to any disclaimer, the term of this patent is extended or adjusted under 35 U.S.C. 154(b) by 0 days.

(21) Appl. No.: 09/603,973

(22) Filed: Jun. 26, 2000

(30) Foreign Application Priority Data

Nov. 19, 1999 (JP) ..... 11-329598

(51) Int. Cl.[7] ..... F04B 17/00

(52) U.S. Cl. ..... 417/423.15; 417/423.1

(58) Field of Search ..... 417/423.15, 423.1, 417/423.7, 423.12, 423.2

(56) References Cited

U.S. PATENT DOCUMENTS

RE37,261 E * 7/2001 Schmider et al. ..... 417/423.7

* cited by examiner

*Primary Examiner*—Charles G. Freay
*Assistant Examiner*—William H Rodriguez
(74) *Attorney, Agent, or Firm*—Oliff & Berridge, PLC

(57) ABSTRACT

A blower with the improved P-Q characteristics is provided. A blower comprising a shaft rotatably supported in a tubular casing, a cup shaped motor yoke 11 fixed to the shaft, and a body portion 15 of an impeller 14 comprising a large number of blades 13 on an outer peripheral portion is fixed to the motor yoke 11, wherein the blower is characterized in that substantially ring-like openings 15*b* are provided at a portion where the blades 13 of the body portion 15 are mounted and on a circumference around the shaft. Since air flow is facilitated by the openings 15*b*, the P-Q (pressure—flow rate) characteristics are improved.

2 Claims, 6 Drawing Sheets

FIG.6

| flowing rate $m^3/min$ | pressure Pa | speed $min^{-1}$ |
|---|---|---|
| 0.000 | 238.3 | 4831 |
| 0.038 | 234.8 | 4832 |
| 0.063 | 232.5 | 4824 |
| 0.099 | 225.4 | 4806 |
| 0.139 | 219.1 | 4784 |
| 0.178 | 212.7 | 4759 |
| 0.223 | 204.2 | 4720 |
| 0.275 | 194.4 | 4675 |
| 0.325 | 181.7 | 4612 |
| 0.372 | 166.6 | 4546 |
| 0.419 | 151.8 | 4474 |
| 0.460 | 140.0 | 4429 |
| 0.499 | 124.9 | 4353 |
| 0.537 | 108.3 | 4257 |
| 0.575 | 90.7 | 4165 |
| 0.617 | 72.8 | 4086 |
| 0.658 | 55.1 | 4017 |
| 0.699 | 36.6 | 3938 |
| 0.740 | 14.8 | 3833 |
| 0.778 | 0.0 | 3739 |

FIG. 7

| flowing rate $m^3/min$ | pressure Pa | speed $min^{-1}$ |
|---|---|---|
| 0.000 | 204.8 | 5046 |
| 0.038 | 202.4 | 5015 |
| 0.072 | 197.7 | 4969 |
| 0.108 | 190.7 | 4923 |
| 0.144 | 185.8 | 4890 |
| 0.187 | 179.3 | 4840 |
| 0.233 | 170.4 | 4775 |
| 0.278 | 159.5 | 4719 |
| 0.328 | 149.5 | 4653 |
| 0.372 | 137.8 | 4578 |
| 0.420 | 128.7 | 4481 |
| 0.461 | 121.9 | 4390 |
| 0.503 | 112.2 | 4305 |
| 0.538 | 100.1 | 4223 |
| 0.576 | 84.7 | 4126 |
| 0.617 | 69.7 | 4051 |
| 0.660 | 54.1 | 3970 |
| 0.695 | 38.4 | 3882 |
| 0.739 | 18.2 | 3799 |
| 0.773 | 0.0 | 3743 |

BLOWER

BACKGROUND OF THE INVENTION

1. Field of the Invention

The present invention relates to an improvement of a blower for use in various kinds of office automation apparatus.

2. Description of the Related Art

In various kinds of office automation apparatus, since a large number of electronic circuits are housed in a box of the apparatuses, it is difficult to discharge heat generated by electronic components forming the electronic circuits, and thus, there is a fear that a part of the electronic components may be broken or deteriorated. In particular, in the context of the recent trend toward miniaturization of office automation apparatuses, since the apparatuses are miniaturized while the quantity of heat generated almost remains the same, how to deal with the heat is an important technical problem to be solved. In order to solve the problem, an air vent for attaching a blower therein is provided in a side wall of an apparatus to discharge the heat inside to the outside of the apparatus, thereby preventing damage due to the heat generated inside.

An example of a conventionally often used blower is described with reference to FIG. 3. Sign 1 shows a casing which is tubular. An integrally molded housing 2 is provided on the right in FIG. 3 inside the casing 1. A bearing liner 3 is inserted into the housing 2. Outer races of bearings 4 and 5 are supported by the inner side of the bearing liner 3, and a shaft 6 is inserted into the inner races of the bearings 4 and 5. A race 7 is attached to the lower end of the shaft 6 for preventing the shaft 6 from falling off and for axially positioning the shaft 6.

Knurl 8 is provided on the upper end of the shaft 6, and is fixed to a boss 9 formed by die casting zinc. Springs 10 are provided between the boss 9 and the inner race of the bearing 4 for providing thrust load on the bearing 4. A center portion of a cup-like motor yoke 11 is fixed to the boss 9. On the boss 9, the central portion of a cup shaped yoke 11 is fixed, and on the inner peripheral portion, a ring shaped magnet 12 is fixed. A body portion 15 of an impeller 14 provided with blades 13 is fixed to the outer peripheral portion of the motor yoke 11. The shaft 6, the motor yoke 11 and the impeller 14 form a rotating portion.

A stater core 17 around which a stator winding 16 is wound, is provided in the inner peripheral portion of the motor yoke 11 to form a fixed portion. A pin-like connection terminal 18 is provided in a projected manner from the stator core 17 downwardly to pierce a PC board 19 supported by the housing 2. An electronic circuit is mounted on the PC board 19 for controlling the current to be supplied to the stator winding 16.

FIG. 4 is a front view of the impeller 14 shown separately from the other elements in FIG. 3, and FIG. 5 is a half section of the impeller 14 taken along the line 5—5 in FIG. 4. As shown in FIG. 4, the blades 13 are arc-like. The large number of blades 13 are attached to the body portion 15 radially to form the impeller 14. The configuration of the body portion 15 is, as shown in FIG. 5, formed in an outwardly cup shape. To the radially extended portion 15*a* the inner peripheral portions of the blades 13 are fixed.

The blower structured as described above is used by mounting on an air vent in a box of an office automation apparatus. The blower is attached such that the top in FIG. 3 is the outer side of the box of the office automation apparatus and the shaft 6 is horizontally oriented. In that state, when power is supplied through the control circuit on the PC board 19, controlled current passes through the stator winding 16 to generate magnetic flux through the stator core 17. Then, the magnetic interference between the magnetic flux and the magnetic flux generated by the magnet 12 rotates the rotating portion. Due to the rotation of the impeller 14, the air sucked from the center of the impeller 14 flows radially by the centrifugal force. The air is then collected in the casing 1 and is discharged from an outlet (not shown) provided in the casing 1. By this blowing, the inside of the box is cooled.

The required characteristics of a blower of this kind is represented as the relationship between the pressure P and the flowing rate Q, i.e., the P-Q characteristics. Among blowers of a given size, one with a high air flow pressure and with a large amount of air flow is determined to be one with satisfactory P-Q characteristics. When circumstances do not allow the blower to be larger and still the P-Q characteristics have to be improved, the improvement can be attained by increasing the number of rotations. However, there is a problem that merely increasing the number of rotations not only increases the noise when the blower is in operation but also shortens the lifetime of the blower.

SUMMARY OF THE INVENTION

The present invention has been made in view of the above, and an object of the invention is to provide a blower suitable for use in severe circumstances.

In order to solve the above-mentioned problem, according to a first aspect of the present invention, there is provided a blower in which a shaft is rotatably supported in a tubular casing, a cup shaped motor yoke is fixed to the shaft, and a body portion of an impeller comprising a large number of blades on an outer peripheral portion is fixed to the motor yoke, characterized in that substantially ring-like openings are provided at a portion where the blades of the body portion are mounted and on a circumference around the shaft.

According to a second aspect of the present invention, in the blower as described in the first aspect of the present invention, it is characterized in that the openings substantially form a long opening in an arc along the direction of the arrangement of the large number of blades.

In a blower structured as mentioned in the above, when the impeller is rotating, air flows through the openings provided according to the present invention.

BRIEF DESCRIPTION OF THE DRAWINGS

In the accompanying drawings:

FIG. 6 is a table showing the characteristics of the blower according to the present invention;

FIG. 7 is a table showing the characteristics of the conventional blower.

DETAILED DESCRIPTION OF THE PREFERRED EMBODIMENTS

Figure 1:
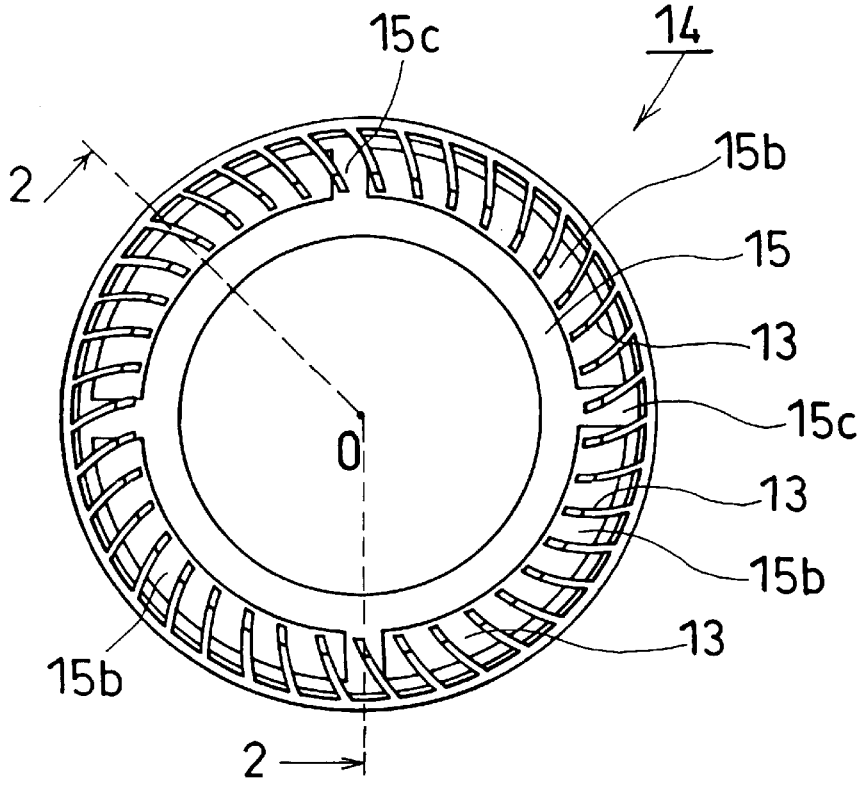
FIG. 1 is a front view of an impeller of a blower according to the present invention shown separately from other elements.
Figure 2:
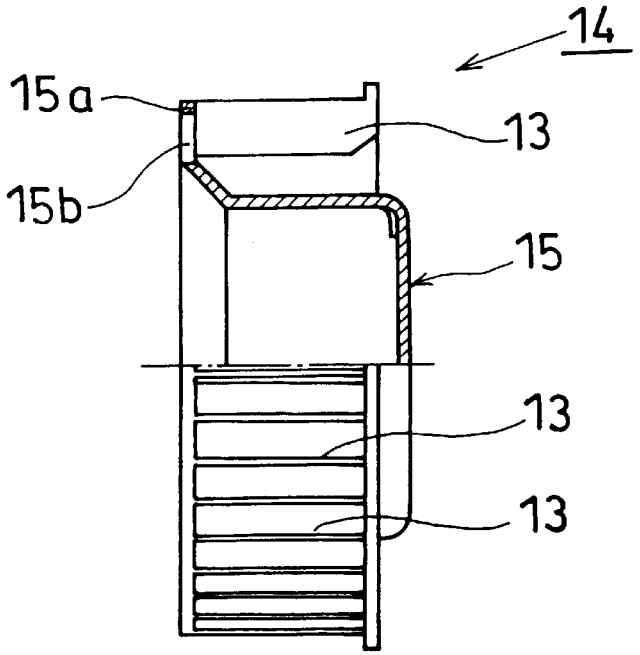
FIG. 2 is a partially sectional view of the impeller taken along the line 2—2 in FIG. 1.
Figure 3:
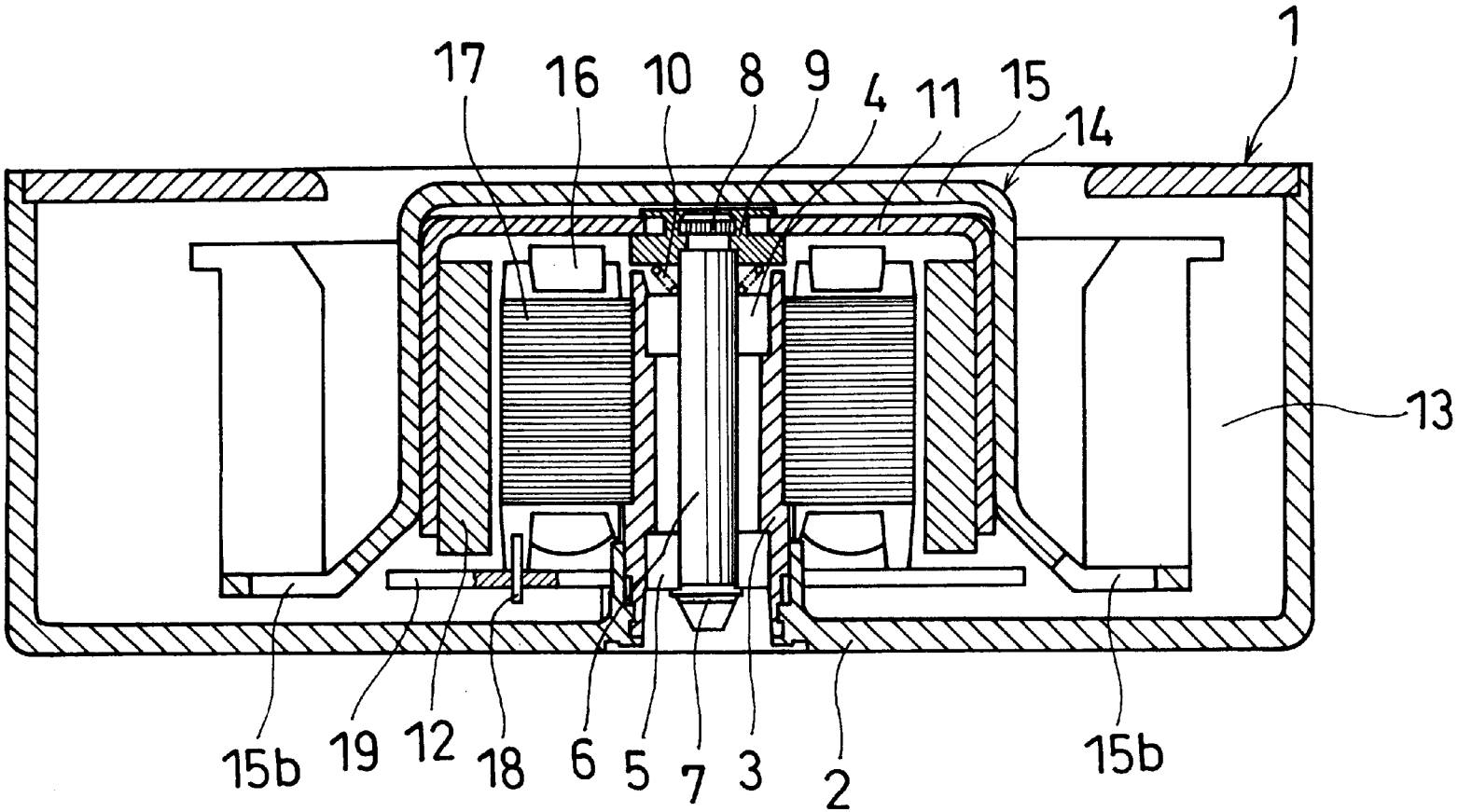
FIG. 3 is a partially sectional view of the blower according to the present invention.

An embodiment of the present invention is now described with reference to FIGS. 1 and 2. FIG. 2 is a partially sectional view of the impeller taken along the line 2—2 in FIG. 1. According to the present invention, substantially ring-like openings 15*b* are provided at a portion where the blades 13 of the body portion 15 are mounted (in the radially extended portion 15*a*) and on a circumference of a circle around the shaft 6, the openings 15*b* extending along the direction of the arrangement of the large number of blades 13 being extended along the axial direction of the shaft 6. As shown in FIG. 1, the openings 15*b* are long, and provided almost all around the circumference with only four connecting portions 15*c* remaining.

Figure 4:
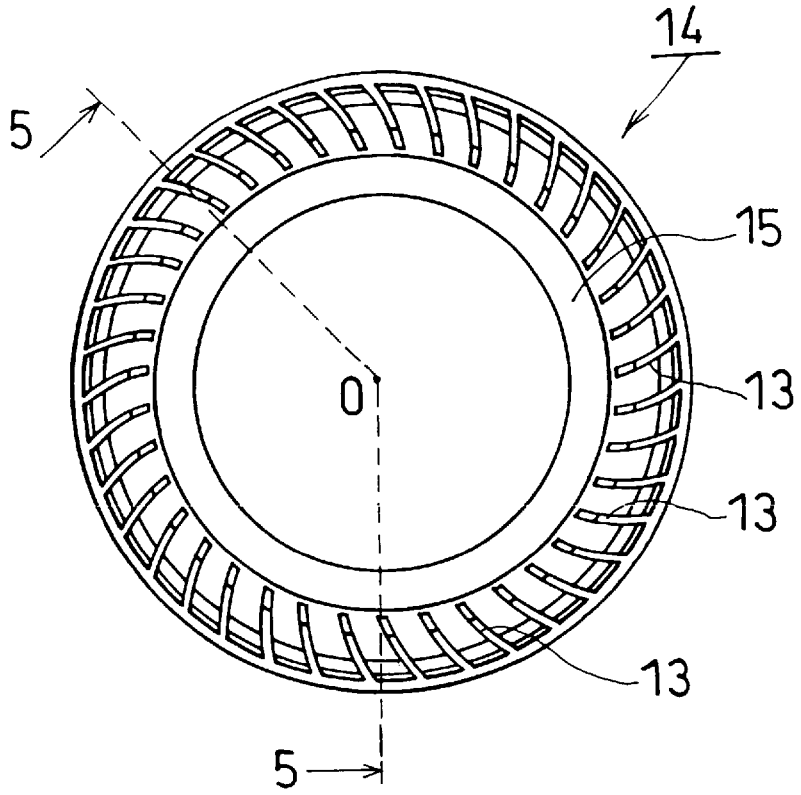
FIG.4 (Prior Art)
FIG. 4 is a front view of a conventional impeller shown separately from other elements.
Figure 5:
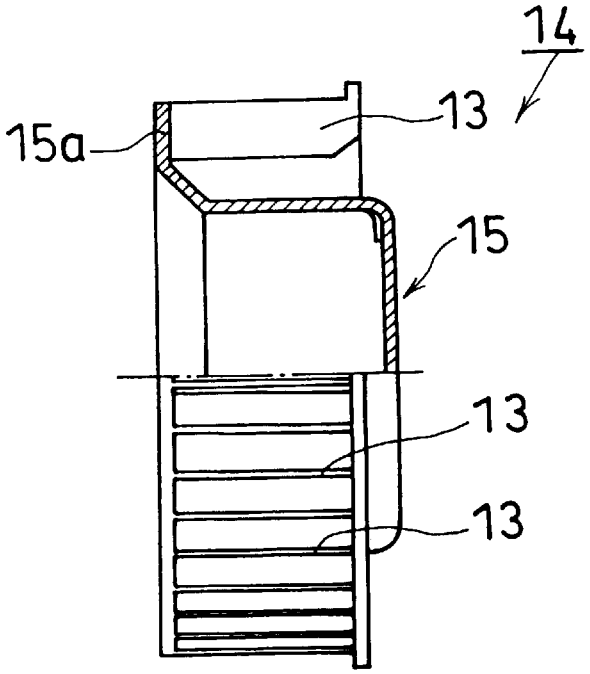
FIG.5 (Prior Art)
FIG. 5 is a partially sectional view of the impeller taken along the line 5—5 in FIG. 4.

When the blower according to the present invention with the openings 15*b* provided at the portion where the blades 13 of the body portion 15 are mounted (in the radially extended portion 15*a*) is in operation, since the blades 13 suck air from the openings 15*b* provided adjacent thereto, better air flowing can be obtained compared with a case where a conventional blower with no such openings (see FIGS. 4 and 5).

Figure 8:
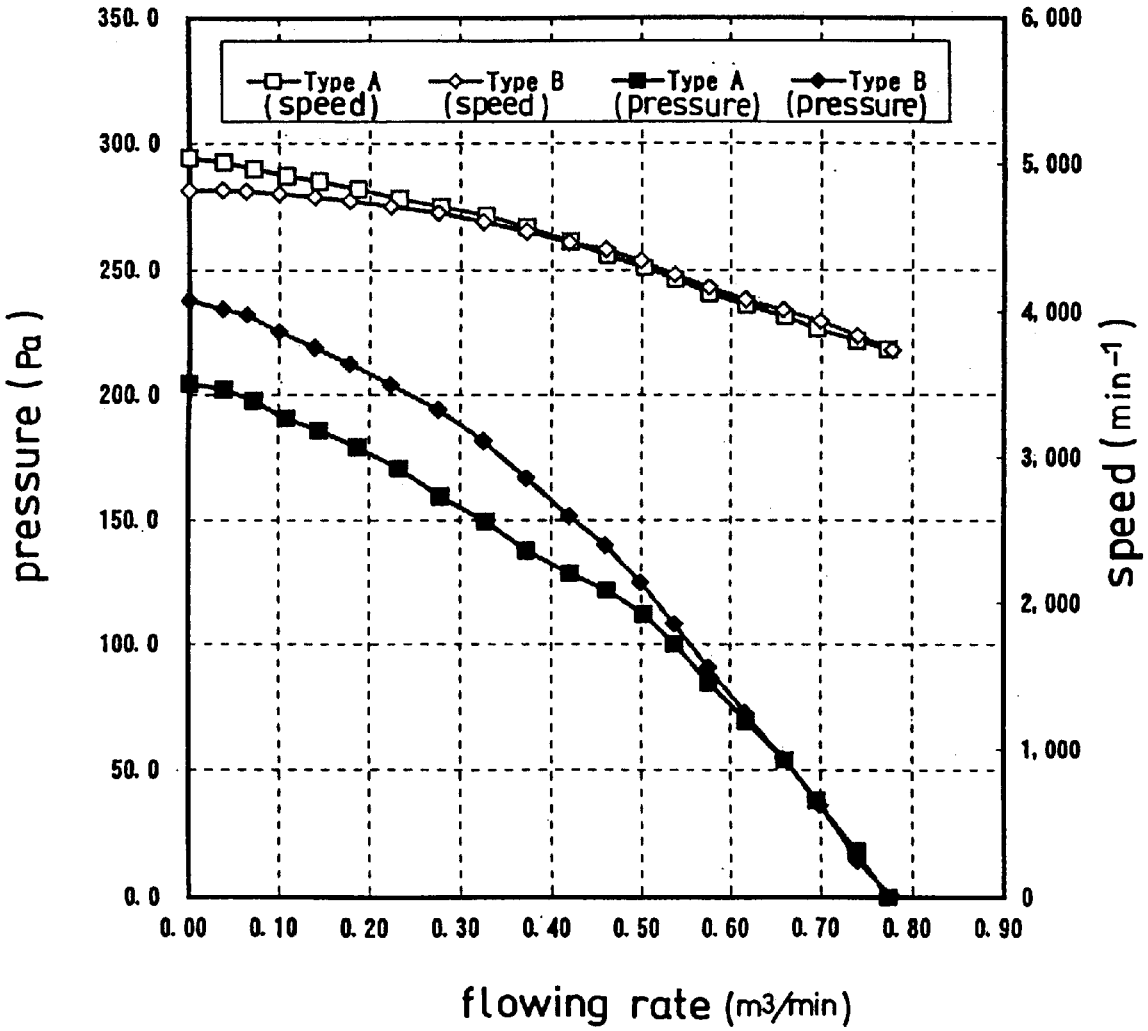
FIG. 8 is a graph showing the characteristics of the blower according to the present invention and of the conventional blower.

Tables shown in FIGS. 6 and 7 are with respect to the blower according to the present invention and the conventional blower, respectively. The tables show changes in the pressure and the speed with the flowing rate of air as the parameter. The tables show that, with the blower according to the present invention, as the flow rate decreases, the pressure rises more steeply and the speed rises more gently compared with the case where the conventional blower is used. FIG. 8 plots the data shown in FIGS. 6 and 7. In FIG. 8, type A denotes the conventional blower while type B denotes the blower according to the present invention. The data was collected from actually manufactured blowers. It can be seen that, the flow rate when, for example, the static pressure is 150 Pa is, 0.328 $m^3$/min with regard to the conventional blower and 0.419 $m^3$/min with regard to the blower according to the present invention, which clearly shows the improvement attained by the present invention.

A blower according to the first aspect of the present invention has a simple structure only with the openings provided at a portion where the blades of the body portion are attached, and thus, the P-Q characteristics can be improved without making the blower larger. Further, a blower according to the second aspect of the present invention defining the position and the shape of the openings can enhance the above effect.

What is claimed is:

1. A blower comprising a shaft which is supported rotatably in a tubular casing, a cup shaped motor yoke fixed to said shaft, and a body portion of an impeller comprising a plurality of blades on an outer peripheral portion fixed to said motor yoke, wherein substantially ring-like openings are provided in the body portion where said plurality of blades are mounted and on a circumference of a circle around said shaft.

2. A blower according to claim 1, wherein said openings substantially form a long opening in an arc extending along the direction of the arrangement of said plurality of blades.

* * * * *